US005514054A

United States Patent [19]

Rowan

[11] Patent Number: 5,514,054

[45] Date of Patent: May 7, 1996

[54] STILTS

[76] Inventor: Michael G. Rowan, Mains Castle, East Kilbride, Glasgow 674 4NR, Scotland

[21] Appl. No.: 256,038

[22] PCT Filed: Dec. 17, 1992

[86] PCT No.: PCT/GB92/02342

§ 371 Date: Jun. 21, 1994

§ 102(e) Date: Jun. 21, 1994

[87] PCT Pub. No.: WO93/11833

PCT Pub. Date: Jun. 24, 1993

[30] Foreign Application Priority Data

Dec. 19, 1991 [GB] United Kingdom ..... 9126971

[51] Int. Cl.[6] ..... A63B 25/00

[52] U.S. Cl. ..... 482/75; 482/76

[58] Field of Search ..... 482/75, 76, 77, 482/121; 623/28, 32, 38, 47, 49, 52

[56] References Cited

U.S. PATENT DOCUMENTS 2,357,893 9/1944 Harrington ..... 623/49

3,070,807 1/1963 Wheeler ..... 482/75

4,927,137 5/1990 Speer ..... 482/76

FOREIGN PATENT DOCUMENTS

91/11222 8/1991 WIPO .

*Primary Examiner*—Lynne A. Reichard

*Attorney, Agent, or Firm*—Bell Seltzer Park & Gibson

[57] ABSTRACT

A pair of stilts, each stilt (12; 80) having a user foot support (14; 82) coupled to an upper leg (18; 84) and to a lower leg (16; 86). The upper leg (18; 84) is secured to the leg of a user. A foot (20; 102) is coupled to the lower end of the lower leg (16; 86). The upper leg (18; 84) includes two side members (18b; 88, 90) each configured to resist torsional forces and thus to provide stability. Each stilt may include a knee protector (124) mounted to the upper end of the upper leg (84) and arranged to prevent hyperextension of the knee of the user.

12 Claims, 4 Drawing Sheets

STILTS

BACKGROUND OF THE INVENTION

This invention relates to stilts.

Stilts are well known and are used to increase the height of an individual and to permit the individual to walk from one position to another at an elevated level. Stilts are worn by circus clowns and other entertainers, but specialist stilts may be worn by tradesmen or fruit-pickers who have to work in areas above normal arms-reach and where it is otherwise difficult to install platforms, ladders and the like.

In their simplest form, stilts comprise a pair of elongate members, each member supporting a block which provides a platform for a foot of the user. The lower end of each member engages the ground, while the upper end serves as a hand grip. In other versions, the members are strapped to the respective lower legs of the user. Such stilts have traditionally been fabricated from wood. However, various forms of improved stilts are disclosed in my International Patent Publication No. WO91/11222. The embodiments of stilts described each have a resilient foot which considerably facilitates walking, particularly when compared with conventional, rigid stilts. In one embodiment the flexible foot is hinged to move laterally as well as back to front and this improves the stability of the stilt and facilitates running and use of the stilts in sports. The disclosed arrangement includes a foot having a flat sole and two upstanding portions which define a longitudinal channel to receive a downward projection on a lower stilt member. The downward projection carries a pivot pin which is received in vertical slots provided in the upstanding projections on the foot. Coil springs are provided at the front and rear of the foot and a shock absorbing rubber pad is also disposed between the top of the sole and the bottom of the leg projection to cushion the wearer whilst walking or running. While this arrangement has been found generally satisfactory it has been found that, on occasion, because the flat sole stays in contact with the ground, lateral movement of the stilt may cause the pivot pin to be dislodged from one of the slots when the stilt is tilted to one side. Also, the arrangement is relatively complex to manufacture.

Other forms of stilts provided with resilient feet have been proposed including those disclosed in U.S. Pat. Nos. 2,835,493 and 4,927,137 to R. P. Skaggs et al and Speer, respectively. Skaggs et al disclose a foot arrangement somewhat similar to my own arrangement as described above, but without the provision of a shock absorber, and Speer provides a clevis on the lower leg portion of the stilt which is attached, by means of a pivot pin, to an upstanding rib on a foot plate. Further, Speer and Skaggs differ somewhat from my prior proposal in that the foot plates are not capable of pivoting about a front to back, or longitudinal axis.

Further, while existing stilt designs may be adequate for simple walking, when slits have been used during sports, acrobatics or in performance arts difficulties have been encountered due to the increased forces which the stilts must bear. In traditional stilt design, the upper stilt member which extends upwardly from the foot support platform is strapped to the outside of the calf of the user. Thus, the calf strap is subject to twisting forces or torques which may be uncomfortable to the user. Also, with this arrangement it is difficult to prevent relative movement between the upper stilt member and the leg. In my WO91/11222 I disclose a number or stilt configurations in which the upper stilt member extends up the front of the leg, to also act as a shin guard, but in use it has been found that, without very heavy construction, the upper stilt member is prone to flexing in response to torques, which creates an undesirable sensation of instability for the user.

In Speer's US Patent, the upper section of the stilt includes two parallel support members for disposition on either side of the user's leg. Both members are longitudinally rigid and the outer member is also preferably laterally rigid. However, the inner member may be thinner and may be designed with some material flexibility so as to allow the inner member to conform closely to the leg. Thus, it is considered that this stilt arrangement will suffer from the disadvantages of the traditional stilt arrangements described above.

U.S, Pat. Nos. 4,570,926 and 4,449,256 to Ensmenger and Prueitt, respectively, and French Patent Document No. 2,594,344 to Champel disclose various stilt arrangements in which a member extends up each side of the leg of the wearer to a securing band. In each of these arrangements the members are pivotally mounted to the foot support such that the members will likely not resist torsion very well and thus tend to move relative to one another, producing a sensation of instability.

For use in sports and other active uses of stilts, there is also the danger that the knee, through a fall or collision, could be subject to a large force tending to hyperextend or bend the knee the 'wrong' way. Such accidents occur in other sports and can result in tendon damage often requiring extensive restorative surgery and a lengthy recovery period, and a long term reduction in knee strength and flexibility.

Various embodiments of the stilts disclosed in my WO91/11222, and also Speer, include knee protecting pads, but these offer minimal protection against the type of injury described above.

It is an object of one of the aspects of the present invention to provide stilts having an improved foot configuration.

It is an object of another aspect of the present invention to provide stilts having an improved upper leg configuration.

It is an object of a still further aspect of the present invention to provide stilts having improved knee protection.

SUMMARY OF THE INVENTION

According to one aspect of the present invention there is provided a pair of stilts, each stilt having a user foot support coupled to an upper leg and to a lower leg and a foot coupled to the lower end of the lower leg, the foot having a longitudinally extending arcuate ground engaging portion and including an upstanding portion received in a longitudinal channel in the lower leg and being pivotally connected thereto for limited movement about a lateral axis, the foot being biassed into a median position by spring means, and shock absorbing means being positioned between the upstanding portion and the lower leg.

Each foot is thus securely located on the respective lower leg, the limited movement about the lateral axis facilitating normal walking and maintaining a larger area of each foot in contact with the ground through rotation of the respective lower leg. The provision of shock absorbing means between each foot and the respective lower leg minimises the shocks transferred through the stilts and facilitates running and jumping. Each upper leg may be strapped or otherwise secured to the lower leg of a user. The arcuate ground engaging portion of each foot allows an area of foot to remain in contact with the ground as a person wearing the stilts leans to the side.

Preferably, the spring means is in the form of front and rear springs located between the front and rear of each foot portion and the respective lower leg, to the front and rear of the respective upstanding portion. Most preferably, the springs are located over upstanding pins extending from a sole portion of the foot through corresponding apertures in the lower leg. Most preferably, the walls of the longitudinal channel in the lower legs are configured to define a skirt to substantially enclose the respective upstanding portion and the spring, to minimise the possibility of clothing or other objects being caught between the lower legs and the feet.

Preferably also, the pivotal mounting of each foot on the respective lower leg is provided by pivot shafts or a pivot pin extending from the upstanding portion and elongate slot recesses or apertures in the base of the leg to allow for vertical movement of the leg on compression of the shock absorbing means. The pivot pin may be biassed towards the base of the respective slot by the shock absorbing means which is preferably in the form of a block of rubber or other resilient material.

According to another aspect of the present invention there is provided a pair of stilts, each stilt having a user foot support coupled to an upper leg and to a lower leg, means for securing the upper leg to the leg of a user, and a foot coupled to the lower end of the lower leg, the upper leg including two side members each configured to resist torsional forces. Preferably, the upper leg securing means is mounted to a portion of the upper leg at a location to the front of the leg of the user. With such an arrangement the major forces applied to the leg of the user are simple pushing and pulling forces, which are more comfortably withstood than torsional forces, which would be experienced if the means was secured to a stilt upper leg to the side of the leg of the user.

Preferably also, the upper leg includes a front member extending upwardly from a front portion of the foot support. The front member serves to protect the shin of the wearer and also allows the bracing side members to extend upwardly from rear portions of the foot support to create a light but rigid triangular configuration of members. Most preferably, the lower leg has a similar, inverted, triangular arrangement of members.

Preferably also, the side members are of a relatively thin section, and may be corrugated or ribbed to provide additional rigidity.

Preferably also, each stilt is of a plastics material, and the members are arranged such that the major structure of each stilt may be formed in a single moulding operation.

According to a still further embodiment of the present invention there is provided a pair of stilts, each stilt having a user foot support coupled to an upper leg and to a lower leg, means for securing the upper leg to the leg of a user, a foot coupled to the lower end of the lower leg, and knee protecting means mounted to the upper end of the upper leg and arranged to prevent hyperextension of the knee of the user.

Preferably, the knee protecting means is arranged for location in front of the leg of the user and extends above the knee of the user.

Preferably also, the knee protecting means includes means for attachment to the leg of the user and includes a link permitting the knee protecting means to flex with the leg of the user. The link may be a pivot or a flexible portion.

Preferably also, the knee protecting means includes a relatively rigid pad, for protecting the knee from impacts, and upper and lower cuffs pivotally mounted to the pad, the lower cuff being mounted to the upper leg of the stilt.

Preferably also, the degree of pivoting between the parts of the knee protecting means is restricted by providing stops on the parts or by providing slots or channels in one part and followers in another part, the length of the slots or channels limiting movement of the followers and thus limiting relative pivoting of the parts.

The various aspect of the invention may be provided individually or in combination.

BRIEF DESCRIPTION OF THE DRAWINGS

Embodiments of the present invention will now be described, by way of example, with reference to the accompanying drawings, in which.

DETAILED DESCRIPTION OF THE PREFERRED EMBODIMENTS

Figure 1:
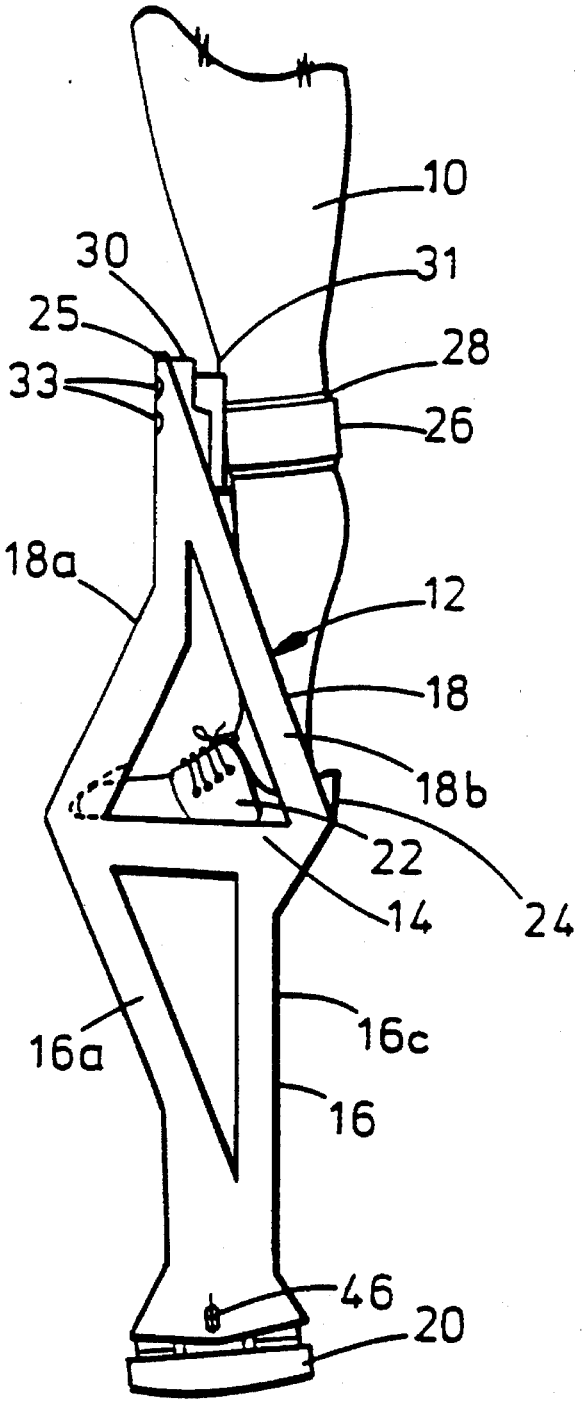
FIG. 1 is a side view of a stilt in accordance with an embodiment of the present invention, also showing the leg of a user.
Figure 2:
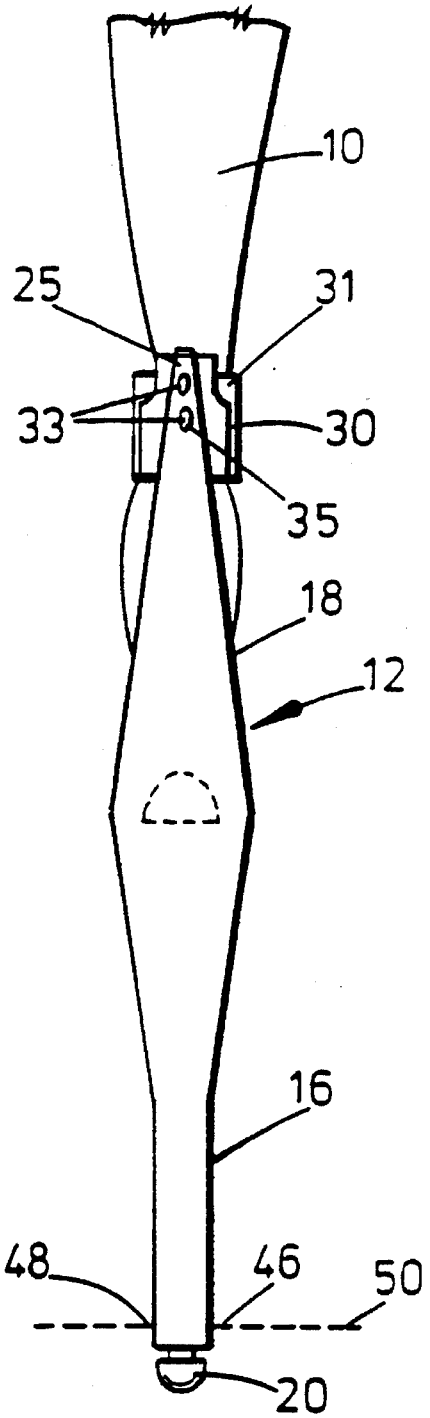
FIG. 2 is a front view of the stilt of FIG. 1.

Reference is first made to FIGS. 1 and 2 of the drawings which depict the lower leg 10 of a person wearing one of a pair of stilts 12 in accordance with one embodiment of the present invention. The stilts of each pair are similar and accordingly only one stilt will be described as exemplary of both. Each stilt 12 has a foot support platform 14 which is integral with a lower stilt leg 16 and an upper stilt leg 18. A foot 20 is pivotally mounted to a lower end of the lower leg 16, as will be described.

The integral upper and lower legs 18, 16 are preferably formed of a plastics moulding, or may be formed from glass reinforced plastic or some other suitable material. The upper and lower legs 18, 16 have front members and pairs of rear members (only one visible in the drawings) **18*a*, 18*b* and 16*a*, 16*b* which resist torsion or twisting improve the stability of the stilt in use. The triangular, open web construction minimises the amount of material and thus the weight of the stilt whilst maintaining strength and rigidity. The upper front members 18*a* also serve to protect the shin of the user. The foot platform 14 is arranged to receive the foot of a person and includes a heel stop 22 and a lace-up adjustable binding 24. The leg of the wearer is also attached to the upper end 25 of the upper leg 18 by means of an adjustable strap 26 provided with padding 28 which is attached to a clip 30 located inside the upper end 25,.a plastic knee pad 31 being located between the rear of the clip 30 and the knee of the user. The upper end 25 has two slots 33 for receiving projections 35** from the clip and which allow vertical adjustment of the clip to suit different sizes of user.

The lower leg 16 narrows below the foot support platform 14 and in this particular example comprises a shell, as most clearly seen in FIG. 4 of the drawings. When a stilt is formed of other materials the stilt may be, for example, solid or have a space frame construction. At the lower end of the leg 16 the shell flares out to the front and back to a distance substantially equal to that of the foot 20, to form a skirt. However, as seen in FIG. 2 the sides of the shell flare out to overlap the narrower foot 20. This provides the stilt with a "clean" appearance and also minimises the possibility of clothing, such as long trousers which might be worn by a performer using the stilts, becoming caught between the leg 16 and the foot 20.

Figure 3:
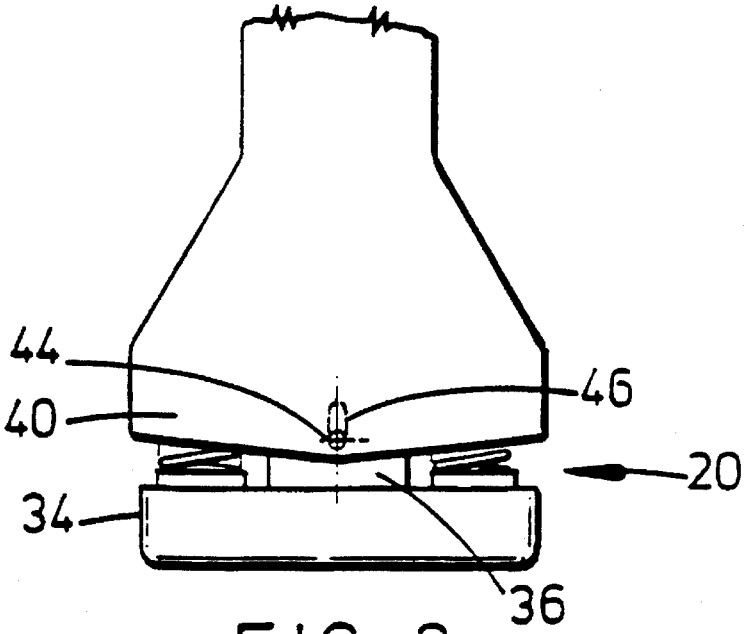
FIG. 3 is an enlarged view of the foot of the stilt of FIG. 1.
Figure 4:
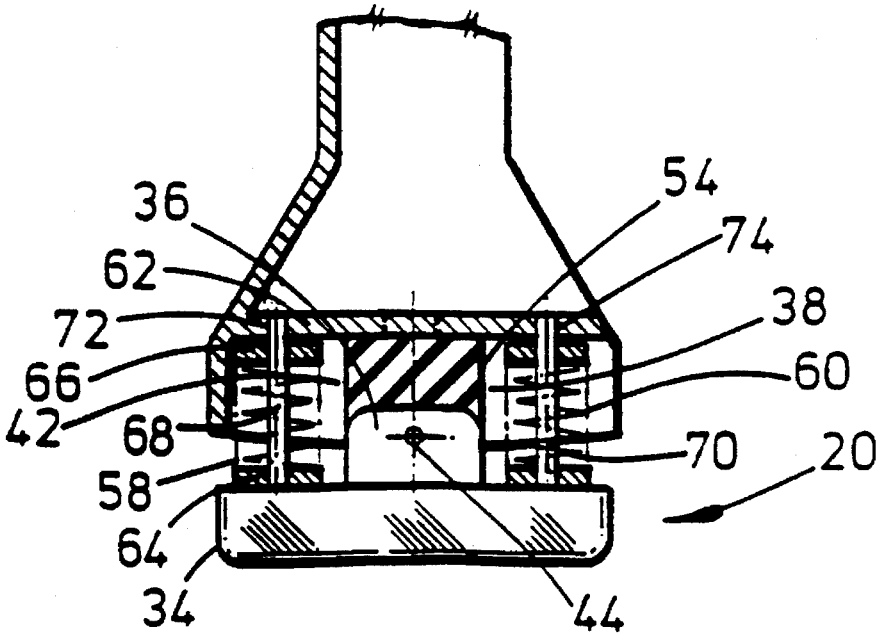
FIG. 4 is a cross-sectional view of FIG. 3.

Referring now to FIGS. 2, 3 and 4 of the drawings it will be noted that the shoe 20 comprises a sole portion 34 which is substantially flat front-to-back and arcuate or curved in cross-section and has an upstanding portion 36 which extends into a longitudinal channel 38 defined by side walls 40, 42 of the lower leg 16. The sole portion 34 includes a replaceable rubber lower cover (not shown separately) which includes upstanding retainers which pass through and engage corresponding apertures in the sole. A pivot pin 44 extends through the upstanding portion 36 and is received by elongate apertures 46, 48 in the respective side walls 40, 42. This provides for limited pivoting about a lateral axis 50 (FIG. 2) to allow rocking of the foot 20 relative to the leg 16 during walking. The pin 44 may of course be replaced by protrusions on the portion 36.

A resilient rubber block 54 provides a shock absorbing means between the leg 16 and foot 20 and is located between a cross-web 62 formed at the lower end of the leg 16 and the top of the upstanding portion 36. Pivoting of the foot about the lateral axis 50 is restrained by the friction between the rubber block 84 and the upstanding portion 36 and further by coil springs 60 mounted on the front and rear ends of the sole 34 and acting on the cross-web 62. The springs 58, 60 are located between resilient washers 64, 66 which are themselves located over respective upstanding pins 68, 70 which extend from the sole 34. The upper ends of the pins 68, 70 pass through corresponding apertures 72, 74 in the web 62.

It has been found that the configuration described above is relatively simple to fabricate, the stilt body, being formed by injection moulding, is lighter (around 3.5 kg) and provides a much improved performance over the various embodiments described in my International Patent Publication No. WO91/11222. Also, as mentioned above, the continuation of the side walls 40, 42 to create a skin which encompasses much of the foot assembly provides a cleaner appearance, minimises the possibility of objects becoming trapped or snagged between the leg 16 and the foot 20, and also improves the strength of the end of the leg.

Figure 5:
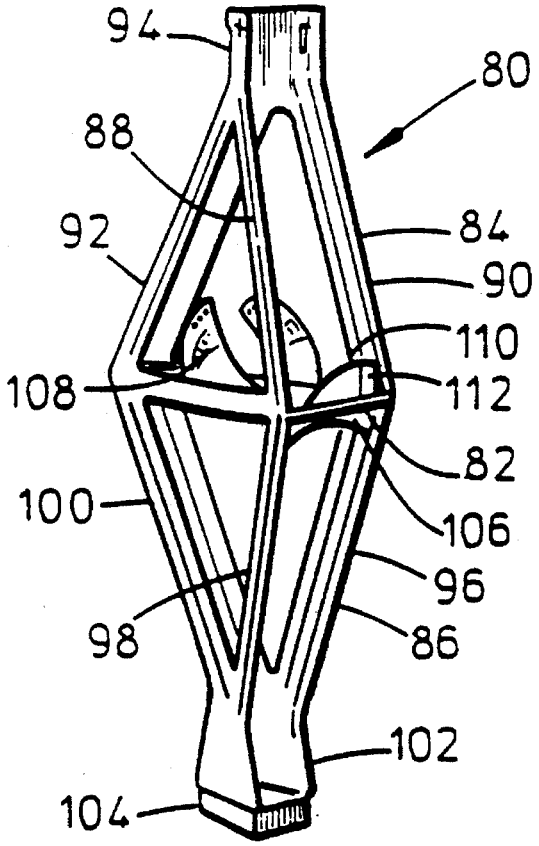
FIG. 5 is a perspective view from the rear of a stilt in accordance with another embodiment of the present invention.

Reference is now made to FIG. 5 of the drawings which illustrates a stilt 80 in accordance with a further embodiment of the present invention. The stilt 80 includes a user foot support 83 coupled to an upper leg 84 and to a lower leg 86. The upper leg 84 includes two side members 88, 90 which extend upwardly from the rear sides of the foot support 82 to merge with a front member 92 which extends upwardly and rearwardly from the front of the support 82. The members 88, 90, 92 merge to provide an arcuate pad 94 for engaging the leg of a user, just below the knee, as may be seen in FIG. 6 of the drawings. The side members 88, 90 are intended to resist torsional forces which would otherwise tend to twist the pad 94 relative to the foot support 82. The front member 92 provides further rigidity and also acts as a shin guard.

The members 82, 92 are of relatively thin section, for lightness, and have a corrugated cross-section to provide additional stiffness. The lower leg 86 is of generally similar configuration to the upper leg 84, comprising two side members 96, 98 and a front member 100. The members 96, 98, 100 merge at a foot portion 102 which is provided with a resilient, replaceable pad 104. The members are arranged such that the structure of the stilt 80 may be formed of a single moulding, requiring minimum further assembly. Such further assembly may include the fitting of various stiffening braces, such as the brace 106 located below the heel portion of the foot support 82, or additional bracing in the foot portion.

Provided on the foot support 82 is a lace-up binding 108 and an adjustable heel stop 110. The heel stop is of a stiff but resilient material and is split at 112 such that on the application of a high force to the stop 110, the users foot may be released, minimising the possibility of injury.

Figure 6:
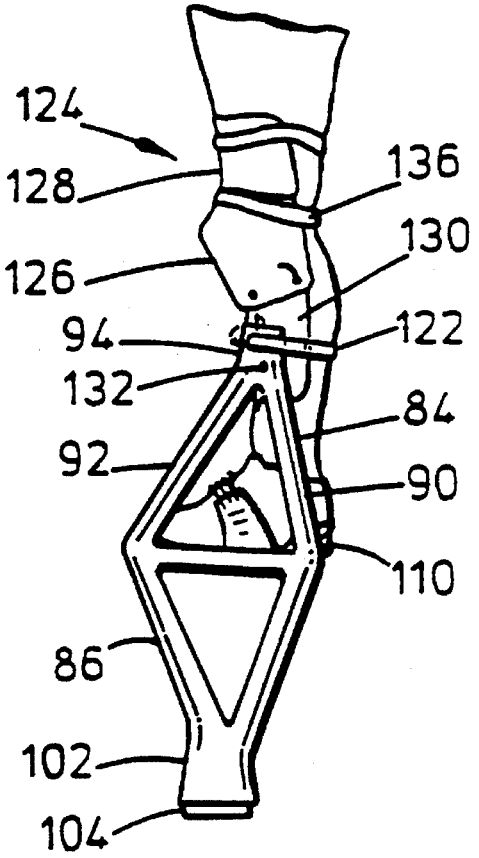
FIG. 6 is a side view of the stilt of FIG. 5 attached to the lower leg of a user and including knee protecting means.
Figure 7:
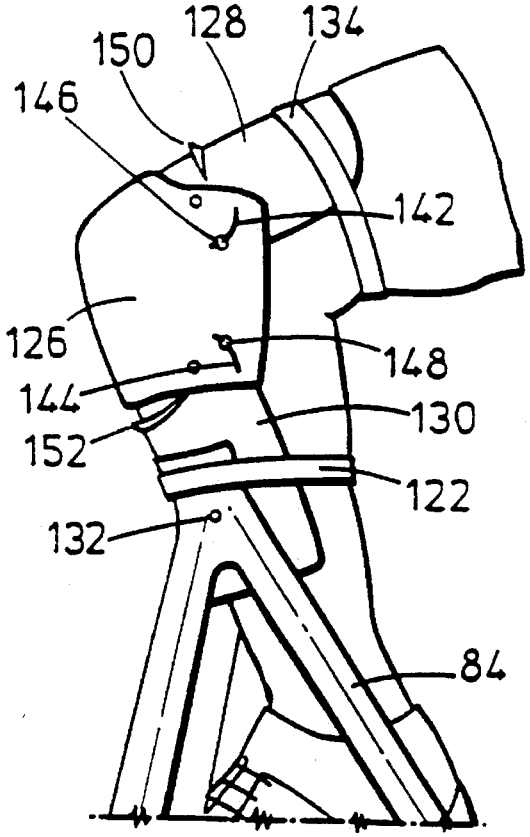
FIG. 7 is an enlarged side view of the stilt and knee protecting means of FIG. 6, showing the knee of the user flexed.
Figure 8:
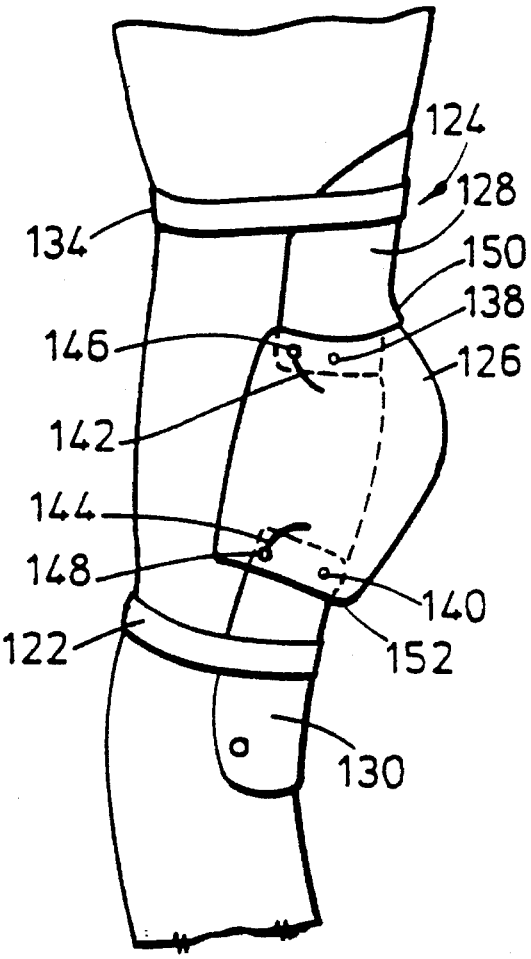
FIG. 8 is a side view of the knee protecting means of FIG. 6, shown separated from the stilt.

The stilt 80 may be used as shown in FIG. 5, with the user's foot held on the foot support 82 by the binding 108 and strapped to the pad 94 by a strap 122, adjustable to accommodate users of different height. However, for use in certain applications, such as sports or activities where the risk of collision or falling is more likely, the user may wish to utilise a knee protector means 124, as shown in FIGS. 6, 7 and 8 of the drawings. As will be explained, the purpose of the protector 124 is to minimise the possibility that the user's knee will be forced into hyperextension, that is bent the "wrong" way. The knee protector 124 includes a relatively rigid impact pad 126 which is pivotally attached to upper and lower cuffs 128, 130, the lower cuff 130 being attached, by means of bolts 132, to the upper leg 84. The upper cuff 128 is held onto the leg of the user by a strap 134 and the stilt strap 122 serves to hold the lower cuff 130 against the leg. If desired, an additional strap 136 (FIG. 6) may be wrapped around the pad 126 to hold the pad in engagement with the knee or the user.

The cuffs 128, 130 are each hingedly attached on either side of the pad 126 by pivot pins 138, 140. The pad 126 also defines slots 142, 144 and follower pins 146, 148 on the cuffs 128, 130 extend into the slots 142, 144. This limits the degree of rotation that is possible between the cuffs and the pad. Further, each cuff 128, 130 is provided with a raised lip 150, 152 which engages the respective upper or lower edge of the pad 126 when the leg of the use is straightened, as is perhaps seen most clearly in FIG. 8. This further limits the range of rotation of the cuffs relative to the pad and thus also limits hyperextension of the leg of the user. However, as will be noted from FIG. 7 of the drawings, the arrangement of the knee protector 124 is such that the user may still freely flex his or her leg.

If desired, the foot portion 102 as shown in FIGS. 5 through 8 may be replaced with the foot 20 as described with reference to the first embodiment, though the arrangement shown in FIGS. 5 through 8 is simpler to produce, lighter and will prove to be adequate most applications.

It will be clear to those of skill in the art that the above described embodiments are merely exemplary of the present invention and that various other arrangements and configurations may be provided within the scope of the invention.

I claim:

1. A pair of stilts, each stilt having a user foot support coupled to an upper leg and to a lower leg, means for securing the upper leg to the leg of a user, and a foot coupled to the lower end of the lower leg, the upper leg including a front member extending upwardly from and being fixed to a central front portion of the foot support and separate side members configured to resist torsional forces and extending upwardly from respective rear side portions of the foot support such that the front member and each one of the side members define a triangular configuration.

2. The stilts of claim 1, in which the upper leg securing means is mounted to a front portion of the upper leg.

3. The stilts of claim 1, in which the lower leg includes a front member extending downwardly from and being fixed to a central front portion of the foot support and side members extending downwardly from respective rear side portions of the foot support.

4. The stilts of claim 1, in which the side members are corrugated or ribbed to provide additional rigidity.

5. The stilts of claim 1, in which each stilt is of a plastics material, and are the major structure of each stilt is formed in a single molding operation.

6. The stilts of claim 1, in which each stilt has a resilient foot.

7. The stilts of claim 1 in which each stilt includes a knee protecting means mounted to the upper end of the upper leg and arranged to prevent hyperextension of the knee of the user.

8. The stilts of claim 1, in which each foot has a longitudinally extending arcuate ground engaging portion and includes an upstanding portion received in a longitudinal channel in the lower leg and is pivotally connected thereto for limited movement about a lateral axis, the foot being biassed towards a median position by spring means, and shock absorbing means being positioned between the upstanding portion and the lower leg.

9. A pair of stilts, each stilt having a user foot support coupled to an upper leg and to a lower leg, means for securing the upper leg to the leg of a user, a foot coupled to the lower end of the lower leg, and a knee protector pivotally mounted to the upper end of the upper leg and arranged to prevent hyperextension of the knee of the user, the knee protector including means for securing the protector to the leg of the user.

10. The stilts of claim 9, in which the knee protector includes a relatively rigid pad, for protecting the knee of the user from impacts, and upper and lower cuffs pivotally mounted to the pad, the lower cuff being mounted to the upper leg of the stilt.

11. The stilts of claim 10, in which the degree of pivoting permitted between the pad and the cuffs is restricted by providing movement limiting stops thereon.

12. The stilts of the claim 10, in which the degree of pivoting permitted between the pad and the cuffs is restricted by providing slots or channels in the pad in the cuffs, the length of the slots or channels limiting movement of the followers and thus limiting relative pivoting between the pads and cuffs.

* * * * *

UNITED STATES PATENT AND TRADEMARK OFFICE

CERTIFICATE OF CORRECTION

PATENT NO. : 5,514,054

DATED : May 7, 1996

INVENTOR(S) : Michael Gray Rowan .

It is certified that error appears in the above-identified patent and that said Letters Patent is hereby corrected as shown below:

Column 7, line 13, omit "are".

Column 8, line 19, omit "the" (first occurrence).

Column 8, line 21, after "pad" insert -- and followers --.

Signed and Sealed this

Sixteenth Day of July, 1996

Bruce Lehman

*Attest:*

BRUCE LEHMAN

*Attesting Officer*

*Commissioner of Patents and Trademarks*